US009912032B2

(12) United States Patent
Morgan et al.

(10) Patent No.: US 9,912,032 B2
(45) Date of Patent: Mar. 6, 2018

(54) WAVEGUIDE ASSEMBLY HAVING A CONDUCTIVE WAVEGUIDE WITH ENDS THEREOF MATED WITH AT LEAST FIRST AND SECOND DIELECTRIC WAVEGUIDES

(71) Applicants: TYCO ELECTRONICS CORPORATION, Berwyn, PA (US); Tyco Electronics (Shanghai) Co., Ltd., Shanghai (CN)

(72) Inventors: Chad William Morgan, Carneys Point, NJ (US); Liang Huang, Chengdu (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 100 days.

(21) Appl. No.: 15/002,588

(22) Filed: Jan. 21, 2016

(65) Prior Publication Data

US 2017/0170540 A1 Jun. 15, 2017

(30) Foreign Application Priority Data

Dec. 14, 2015 (CN) ..... 2015 1 0926954

(51) Int. Cl.

| | |
|---|---|
| ***H01P 5/08*** | (2006.01) |
| ***H01P 1/04*** | (2006.01) |
| ***H01P 1/02*** | (2006.01) |
| ***H01P 3/16*** | (2006.01) |

(52) U.S. Cl.

CPC ..... *H01P 5/087* (2013.01); *H01P 1/022* (2013.01); *H01P 1/042* (2013.01); *H01P 3/16* (2013.01)

(58) Field of Classification Search

CPC .... H01P 3/16; H01P 3/20; H01P 3/121; H01P 3/122; H01P 5/087; H01P 1/02; H01P 1/022; H01P 1/042

USPC ..... 333/239, 241, 242, 254

See application file for complete search history.

(56) References Cited

U.S. PATENT DOCUMENTS

| | | | | |
|---|---|---|---|---|
| 2,829,351 A * | 4/1958 | Fox | ..... | H01P 3/16 333/239 |
| 4,216,449 A | 8/1980 | Kach | | |
| 4,525,693 A * | 6/1985 | Suzuki et al. | ..... | H01P 3/16 156/184 |
| 4,875,026 A * | 10/1989 | Walter et al. | ..... | H01P 3/16 333/239 |
| 2012/0306587 A1 | 12/2012 | Strid et al. | | |

(Continued)

*Primary Examiner* — Benny Lee

(57) ABSTRACT

A waveguide assembly for propagating electromagnetic signals along a defined path includes a conductive waveguide and a dielectric waveguide. The conductive waveguide includes two side walls that extend parallel to each other between first and second ends of the conductive waveguide. A channel is defined between the two side walls. The dielectric waveguide includes a cladding formed of a first dielectric material. The cladding defines a core region therethrough that is filled with a second dielectric material different than the first dielectric material. A mating end of the dielectric waveguide is received in the channel at the first end of the conductive waveguide to electromagnetically connect the dielectric waveguide to the conductive waveguide. A remainder of the dielectric waveguide is exterior of the conductive waveguide and extends away from the conductive waveguide.

20 Claims, 4 Drawing Sheets

(56) References Cited

U.S. PATENT DOCUMENTS

| | | | |
|---|---|---|---|
| 2014/0240187 | A1 | 8/2014 | Herbsommer et al. |
| 2014/0285291 | A1 | 9/2014 | Payne et al. |
| 2014/0368301 | A1 | 12/2014 | Herbsommer et al. |
| 2015/0327357 | A1 | 11/2015 | Khan et al. |
| 2017/0170538 | A1 | 6/2017 | Morgan et al. |
| 2017/0170539 | A1 | 6/2017 | Morgan et al. |

* cited by examiner

WAVEGUIDE ASSEMBLY HAVING A CONDUCTIVE WAVEGUIDE WITH ENDS THEREOF MATED WITH AT LEAST FIRST AND SECOND DIELECTRIC WAVEGUIDES

CROSS-REFERENCE TO RELATED APPLICATIONS

This application claims priority to Chinese Patent Application No. 201510926954.X, filed on 14 Dec. 2015, which is incorporated by reference herein in its entirety.

BACKGROUND OF THE INVENTION

The subject matter herein relates generally to waveguide assemblies that convey high frequency electromagnetic waves along a path.

Dielectric waveguides and conductive waveguides are two types of waveguides used in communications applications to convey high frequency signals in the form of electromagnetic waves along a path. Conductive waveguides typically include conductive walls that are spaced apart to define a cavity therebetween that is filled with air or another dielectric material. The electromagnetic waves propagate along the conductive waveguide through the air cavity between the conductive walls. One drawback of conductive waveguides is that, at high frequency, conductive waveguides have high energy loss, such as return loss and insertion loss, which significantly limits the effective distances that conductive waveguides can transfer signals.

Dielectric waveguides include at least one dielectric material, and typically have two or more dielectric materials. A dielectric is an electrical insulating material that can be polarized by an applied electric field. The polarizability of a dielectric material is expressed by a value called the "dielectric constant" or "relative permittivity." The dielectric constant of a given material is its dielectric permittivity expressed as a ratio relative to the permittivity of a vacuum, which is 1 by definition. A first dielectric material with a greater dielectric constant than a second dielectric material is able to store more electrical charge by means of polarization than the second dielectric material.

Some known dielectric waveguides include a core dielectric material and a cladding dielectric material that surrounds the core dielectric material. The electromagnetic waves propagate along the dielectric waveguide through the core dielectric material, the cladding dielectric material, and potentially also radially outside of the cladding. The distribution of the electromagnetic field within the dielectric waveguide depends, at least in part, on the dielectric constants of the core and cladding dielectric materials. Compared to conductive waveguides, dielectric waveguides have relatively low loss and can therefore transmit high frequency signals over relatively long distances. For example, conductive waveguides may provide communication transmission lines for connecting communication devices, such as connecting an antenna to a radio frequency transmitter and/or receiver.

Dielectric waveguides do have several drawbacks that are evident when using dielectric waveguides to provide a signal transmission path between two remote communication devices. For example, although the available space in an application may require a dielectric waveguide to bend around other components, dielectric waveguides typically do not bend well. As a bend radius shortens, a greater amount of the electromagnetic wave propagating through the waveguide will be emitted from the sides of the waveguide and lost to the surrounding environment. Thus, it may be difficult to obtain a desired waveguide path in an applied environment while maintaining acceptable signal quality and loss levels through the dielectric waveguide. Although it is possible to wrap or otherwise surround the dielectric waveguide in an electrically conductive shielding layer to provide better electromagnetic wave containment, such conductive shielding layers can cause undesirably high loss levels in the dielectric waveguides. Furthermore, outer metal shielding layers can allow undesirable modes of propagation that have hard cutoff frequencies such that, at some specific frequencies, a desired field propagation can be completely halted or "cutoff."

In another example, many applications require a signal transmission path length that is longer than a single dielectric waveguide, so multiple waveguides need to be joined together to achieve the required length. But, it is difficult to join two dielectric waveguides such that electromagnetic waves propagating through a first waveguide are efficiently transferred to a second waveguide across an interface. The ends of the waveguides typically are placed into direct, face-to-face abutment with one another or have a very narrow gap therebetween. Layers of the first waveguide, such as the core and the cladding, must align with respective layers of the second waveguide with a relatively high level of precision in order to reduce reflections at the interface indicative of energy from a transmit waveguide being emitted instead of being received in the corresponding receive waveguide. Due to tooling and assembly tolerances, it is difficult to connect two waveguides face-to-face to achieve the necessary precision that does not increase loss and/or cause signal degradation.

A need remains for a waveguide assembly that can be used for propagating high frequency electromagnetic signals over long distances and/or around tight bends, while providing acceptably low levels of loss.

SUMMARY OF THE INVENTION

In an embodiment, a waveguide assembly for propagating electromagnetic signals along a defined path is provided. The waveguide assembly includes a conductive waveguide and a dielectric waveguide. The conductive waveguide extends between a first end and a second end. The conductive waveguide includes two side walls that extend parallel to each other between the first and second ends. The conductive waveguide defines a channel between the two side walls. The channel is open at the first and second ends. The dielectric waveguide has a mating end. The dielectric waveguide includes a cladding formed of a first dielectric material. The cladding defines a core region therethrough that is filled with a second dielectric material different than the first dielectric material. The mating end of the dielectric waveguide is received in the channel at the first end of the conductive waveguide to electromagnetically connect the dielectric waveguide to the conductive waveguide. A remainder of the dielectric waveguide is exterior of the conductive waveguide and extends away from the conductive waveguide.

In another embodiment, a waveguide assembly for propagating electromagnetic signals along a defined path is provided. The waveguide assembly includes a conductive waveguide and first and second dielectric waveguides. The conductive waveguide extends between a first end and a second end. The conductive waveguide includes two side walls that extend parallel to each other between the first and second ends. The conductive waveguide defines a channel between the two side walls. The channel is open at the first and second ends. The first and second dielectric waveguides have respective mating ends. Each of the first and second waveguides includes a cladding formed of a first dielectric material. The cladding defines a core region therethrough that is filled with a second dielectric material different than the first dielectric material. The mating end of the first dielectric waveguide protrudes into the channel of the conductive waveguide from the first end thereof, and the mating end of the second dielectric waveguide protrudes into the channel from the second end. The mating end of the first dielectric waveguide is spaced apart longitudinally from the mating end of the second dielectric waveguide within the channel. The conductive waveguide electromagnetically connects the first and second dielectric waveguides to each other.

DETAILED DESCRIPTION OF THE INVENTION

One or more embodiments described herein are directed to a waveguide assembly that includes a conductive waveguide electromagnetically connected to at least one dielectric waveguide. The embodiments of the waveguide assembly are configured to smoothly transfer energy from the conductive waveguide to the dielectric waveguide(s) and vice-versa. Each dielectric waveguide contains a rectangular layer (or other cross-section) which supports field polarization. Thus, electromagnetic waves propagating through a respective dielectric waveguide will polarize along an x-axis or a y-axis. Each dielectric waveguide is aligned with the conductive waveguide such that the mode of electromagnetic energy traveling in the dielectric waveguide can easily excite a mode in the conductive waveguide with the same or a similar polarization that allows for a smooth and efficient transmission of energy from the dielectric waveguide to the conductive waveguide. A small length of each dielectric waveguide is inserted into the conductive waveguide, which may improve signal transmission performance by providing some level of impedance matching.

The conductive waveguide may be a rectangular waveguide or a parallel plate waveguide in various embodiments. In an embodiment, the conductive waveguide bridges two dielectric waveguides that are spaced apart from each other, and the conductive waveguide electromagnetically connects the two dielectric waveguides. Signals may be transferred from one of the dielectric waveguides through the conductive waveguide and subsequently into the other dielectric waveguide. Optionally, the conductive waveguide may be curved or bent instead of linear, such that the conductive waveguide provides a curved connection between two dielectric waveguides or between a dielectric waveguide and a communication device, such as an antenna.

Figure 1:
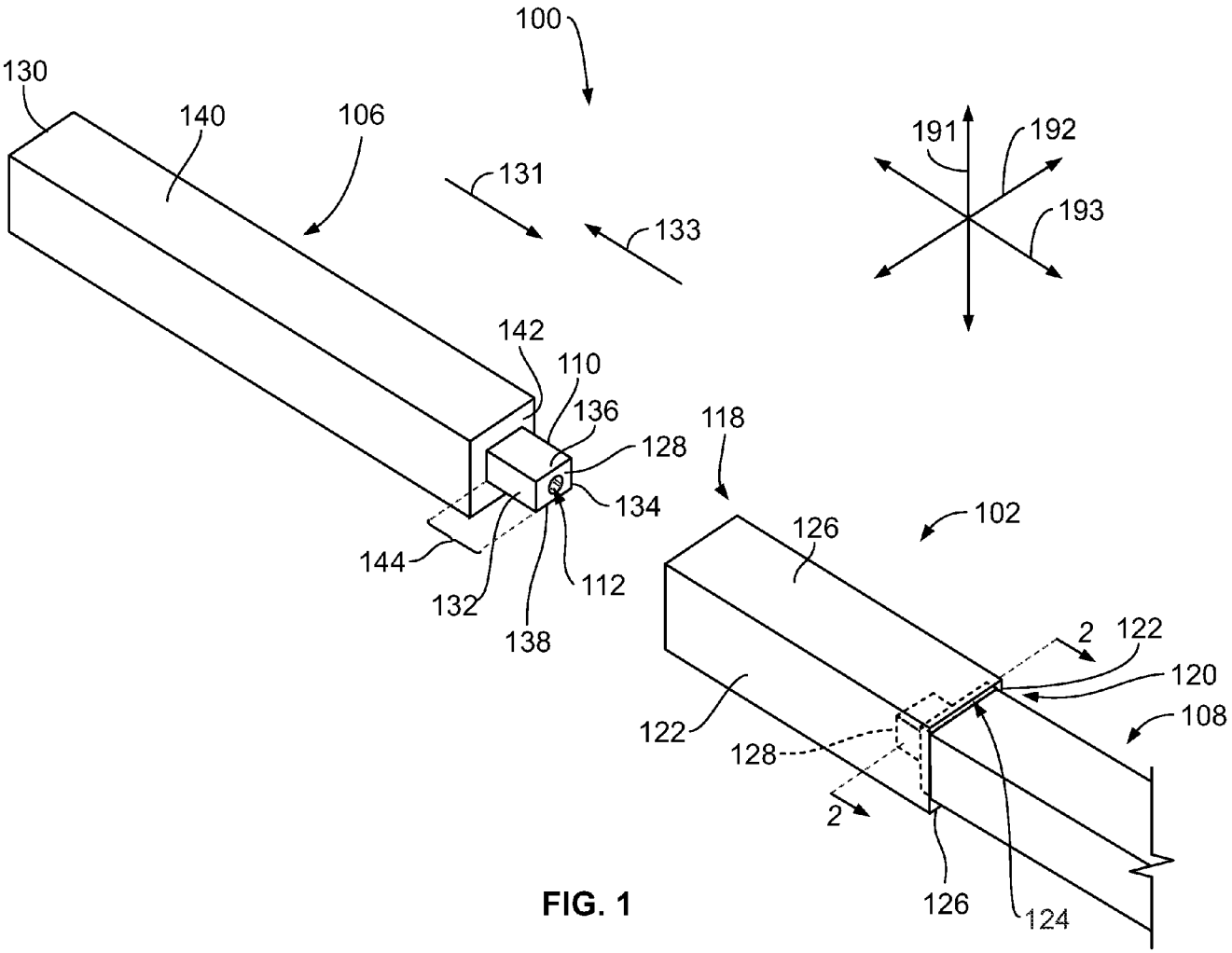
FIG. 1 is a top perspective view of a waveguide assembly formed in accordance with an embodiment.

FIG. 1 is a top perspective view of a waveguide assembly 100 formed in accordance with an embodiment. The waveguide assembly 100 is configured to convey signals in the form of electromagnetic waves along a length of the waveguide assembly 100 for transmission of the signals between two communication devices (not shown). The electromagnetic waves include both electric fields and magnetic fields. The communication devices may include antennas, radio frequency transmitters and/or receivers, computing devices (for example, desktop or laptop computers, tablets, smart phones, etc.), media storage devices (for example, hard drives, servers, etc.), network interface devices (for example, modems, routers, etc.), and the like. The waveguide assembly 100 may be used to transmit high speed signals in the sub-terahertz radio frequency range, such as 120-160 gigahertz (GHz). The high speed signals in this frequency range have wavelengths less than five millimeters. The waveguide assembly 100 may be used to transmit modulated radio frequency (RF) signals. The waveguide assembly 100 may have a variable length in order to extend along a desired linear or circuitous path between the two communication devices to be connected.

The waveguide assembly 100 includes a conductive waveguide 102, a first dielectric waveguide 106, and a second dielectric waveguide 108. The waveguide assembly 100 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity.

The conductive waveguide 102 extends a length between a first end 118 and a second end 120. In the illustrated embodiment, the conductive waveguide 102 is linear and extends parallel to the longitudinal axis 193. The conductive waveguide 102 includes two side walls 122 that extend parallel to each other. The side walls 122 are composed of one or more metals or metal alloys that provide the waveguide 102 with electrically conductive properties. Both side walls 122 extend the length of the waveguide 102 between the first and second ends 118, 120. The side walls 122 are spaced apart from each other to at least partially define a channel 124 that extends the length of the conductive waveguide 102. The channel 124 is open at both the first and second ends 118, 120. The channel 124 is occupied by air and/or another dielectric material in the gas or solid phase.

In the illustrated embodiment, the conductive waveguide 102 further includes two connecting walls 126 that extend between and mechanically engage the side walls 122 to enclose the channel 124. The connecting walls 126 extend parallel to each other and are spaced apart along the vertical axis 191. The connecting walls 126 are perpendicular to the side walls 122. Thus, the conductive waveguide 102 has a rectangular cross-sectional shape. The channel 124 has a rectangular prism shape. The conductive waveguide 102 is a hollow rectangular prism (or cuboid) that is open at both the first and second ends 118, 120. The connecting walls 126 define top and bottom walls, and the side walls 122 define left and right walls. As used herein, relative or spatial terms such as "first," "second," "top," "bottom," "left," and "right" are only used to distinguish the referenced elements and do not necessarily require particular positions, orders, or orientations relative to gravity or relative to the surrounding environment of the waveguide assembly 100.

The first and second dielectric waveguides 106, 108 are configured to mate to the conductive waveguide 102 to electromagnetically connect the respective waveguides 106, 108 directly to the conductive waveguide 102 and indirectly to each other. As shown in FIG. 1, the second dielectric waveguide 108 is mated to the second end 120 of the conductive waveguide 102, and the first dielectric waveguide 106 is poised for mating to the first end 118 of the conductive waveguide 102. The first and second dielectric waveguides 106, 108 may be identical or at least substantially similar. For example, the dielectric waveguides 106, 108 may be composed of the same materials, have the same shapes, and/or may be formed using the same manufacturing process. Thus, the following description of the first dielectric waveguide 106 is also applicable to the second dielectric waveguide 108.

The dielectric waveguide 106 is elongated to extend from a mating end 128 to a distal end 130. In an embodiment, the mating end 128 is configured to be received in the channel 124 of the conductive waveguide 102, and the distal end 130 is disposed outside of the conductive waveguide 102. For example, the mating end 128 of the second dielectric waveguide 108 is shown in phantom protruding beyond the second end 120 of the conductive waveguide 102 into the channel 124. Although not shown in FIG. 1, the mating end 128 of the first dielectric waveguide 106 may protrude beyond the first end 118 of the conductive waveguide 102 into the channel 124 when mated to the conductive waveguide 102.

In an embodiment, when the first and second dielectric waveguides 106, 108 are both mated to the conductive waveguide 102, the mating end 128 of the waveguide 106 is spaced apart from the mating end 128 of the waveguide 108 within the channel 124 such that the first and second dielectric waveguides 106, 108 do not engage one another directly. The conductive waveguide 102 functions as a bridge connector that extends between (or bridges) the first and second dielectric waveguides 106, 108 and electromagnetically connects the dielectric waveguides 106, 108 to each other. For example, the waveguide assembly 100 defines a signal transmission path that has a first length through the first dielectric waveguide 106, a second length through the conductive waveguide 102, and a third length through the second dielectric waveguide 108. An electromagnetic signal in the form of a wave propagating in a first transmission direction 131 through the first dielectric waveguide 106 is emitted from the first dielectric waveguide 106 into the channel 124 of the conductive waveguide 102 and continues to propagate through the conductive waveguide 102 in the same direction. The wave is received in the second dielectric waveguide 108 from the conductive waveguide 102 and continues propagation in the first transmission direction 131. Other signals may be transmitted from the second dielectric waveguide 108 through the conductive waveguide 102 and then into the first dielectric waveguide 106 in a second transmission direction 133 opposite the first direction 131. Thus, the conductive waveguide 102 communicatively links the first and second dielectric waveguides 106, 108, allowing the waveguide assembly 100 to extend a total length that is longer than each of the waveguides 106, 108 individually. Optionally, additional conductive waveguides and dielectric waveguides may be connected in an alternating sequence in order to further increase the length of the waveguide assembly 100.

The dielectric waveguide 106 includes a cladding 110 formed of a first dielectric material. The cladding 110 extends the length of the waveguide 106 between the mating and distal ends 128, 130. The cladding 110 defines a core region 112 therethrough along the length of the cladding 110. The core region 112 is filled with a second dielectric material that is different than the first dielectric material. As used herein, dielectric materials are electrical insulators that may be polarized by an applied electric field. The first dielectric material of the cladding 110 surrounds the second dielectric material of the core region 112. The first dielectric material of the cladding 110 is referred to herein as a "cladding material," and the second dielectric material in the core region 112 is referred to herein as a "core material." The core material has a dielectric constant value that is different than the dielectric constant value of the cladding material. The core material in the core region 112 may be in the solid phase or the gas phase. For example, the core material may be a solid dielectric polymer such as polyethylene, polypropylene, polytetrafluoroethylene (PTFE), or the like. Alternatively, the core material may be one or more gases, such as air.

The respective dielectric constants of the core material and the cladding material affect the distribution of an electromagnetic field within the dielectric waveguide 106. Generally, an electromagnetic field through a dielectric waveguide concentrates within the material that has a greater dielectric constant, at least for materials with dielectric constants in the range of 0-15. In one embodiment, the dielectric constant of the core material in the core region 112 is greater than the dielectric constant of the cladding material, such that electromagnetic fields generally concentrate within the core region 112, although minor portions of the electromagnetic fields may be in the cladding 110 and/or outside of the cladding 110. In another embodiment, the dielectric constant of the core material is less than the dielectric constant of the cladding material, so the electromagnetic fields concentrate generally within the cladding 110, and may have minor portions in the core region 112 and/or outside of the cladding 110.

In an embodiment, the cladding 110 and/or the core region 112 of the dielectric waveguide 106 has a rectangular cross-sectional shape that includes a left edge 132, a right edge 134, a top edge 136, and a bottom edge 138. The left and right edges 132, 134 are parallel to each other. The top and bottom edges 136, 138 are parallel to each other and perpendicular to the left and right edges 132, 134. The rectangular shape orients the electromagnetic field in the waveguide 106 in a specific mode. In the illustrated embodiment, the cladding 110 has a rectangular cross-sectional shape and defines the edges 132, 134, 136, and 138. The core region 112 has a circular cross-sectional shape. In an alternative embodiment, the core region 112 may have the rectangular cross-sectional shape and the cladding 110 may have either a circular or a rectangular cross-sectional shape.

The dielectric waveguide 106 is oriented relative to the conductive waveguide 102 such that a mode of propagation of the electromagnetic waves through the dielectric waveguide 106 excites a corresponding mode of propagation through the conductive waveguide 102 that has the same or a similar field polarization, which allows the electromagnetic waves to efficiently transition from the dielectric waveguide 106 into the conductive waveguide 102. If the dielectric waveguide 106 is not properly oriented relative to the conductive waveguide 102, the portion of the electromagnetic energy that is transmitted between the two waveguides 106, 102 without being reflected or radiated may be greatly reduced. In the illustrated embodiment, the dielectric waveguide 106 is oriented such that the left and right edges 132, 134 of the cladding 110 extend parallel to the side walls 122 of the conductive waveguide 102. The signals transmitted through the waveguide assembly 100 may be transverse waves that propagate in a direction (for example, the transmission direction 131) that is parallel to the longitudinal axis 193, but have oscillations or field components perpendicular to the propagation direction, such as parallel to the lateral axis 192. For example, an electromagnetic signal may propagate through the dielectric waveguide 106 in a first mode having a horizontal field polarization. In the horizontal field polarization, the field may align generally between the left and right edges 132, 134 approximately parallel to the lateral axis 192. Upon transitioning into the conductive waveguide 102, the signal propagates through the channel 124 in a corresponding first mode of the conductive waveguide 102 with a horizontal field polarization. Components of the waves may oscillate or reflect between the two side walls 122 of the conductive waveguide 102, since the conductive walls 122 provide a reflective boundary for the electromagnetic field.

In the illustrated embodiment, the top and bottom edges 136, 138 of the cladding 110 extend parallel to the connecting walls 126 of the conductive waveguide 102. The dielectric waveguide 106 may propagate signals in a second mode that has a vertical field polarization in which the electric field may align parallel to the vertical axis 191. Upon transitioning into the conductive waveguide 102, the signal propagates through the channel 124 in a corresponding second mode of the conductive waveguide 102 with a vertical field polarization. Components of the waves may oscillate or reflect between the two connecting walls 126 that provide a reflective boundary for the electromagnetic field. Therefore, the rectangular edges 132, 134, 136, and 138 of the cladding 110 orient the fields in the dielectric waveguide 106 along a horizontal and/or vertical polarization. The dielectric waveguide 106 is specifically oriented relative to the side walls 122 and/or connecting walls 126 of the conductive waveguide 102 such that the fields in the dielectric waveguide 106 induce a matching or complementary polarization of the fields within the conductive waveguide 102, or vice-versa.

In an embodiment, the dielectric waveguide 106 has an outer jacket 140 that is composed of a dielectric material, such as polypropylene, polyethylene, PTFE, or the like. The outer jacket 140 surrounds the cladding 110. The dielectric outer jacket 140 may contain some portions of the electromagnetic waves that extend outside of the cladding 110. Thus, the dielectric outer jacket 140 may be a buffer between the cladding 110 and the external environment that improves the sensitivity of the waveguide 106 to disturbances caused by human handling or other external influences.

The outer jacket 140 extends to a jacket end 142 that is recessed relative to the mating end 128 of the dielectric waveguide 106. An exposed portion 144 of the cladding 110 that is not surrounded by the outer jacket 140 protrudes beyond the jacket end 142 to the mating end 128. The length of the exposed portion 144 is defined between the jacket end 142 and the mating end 128. The exposed portion 144 of the cladding 110 is exposed to air. When the dielectric waveguide 106 is mated to the conductive waveguide 102, the exposed portion 144 of the cladding 110 is received in the channel 124. Thus, the cladding 110 extends farther into the channel 124 than the outer jacket 140. Forming the exposed portion 144, such as by trimming back the outer jacket 140, reduces the amount of dielectric material that extends into the channel 124. The conductive waveguide 102 may have inherently lower impedance than the dielectric waveguide 106. Extending the exposed portion 144 of the cladding 110 into the channel 124 may provide a level of impedance matching that reduces reflections as electromagnetic signals transition between the dielectric waveguide 106 and the conductive waveguide 102. The core material of the core region 112 may extend into the channel 124 with the exposed portion 144 of the cladding 110. The core material may extend farther into the channel 124 than the cladding material, may extend the same distance as the cladding material, or may not extend as far as the cladding material.

Figure 2:
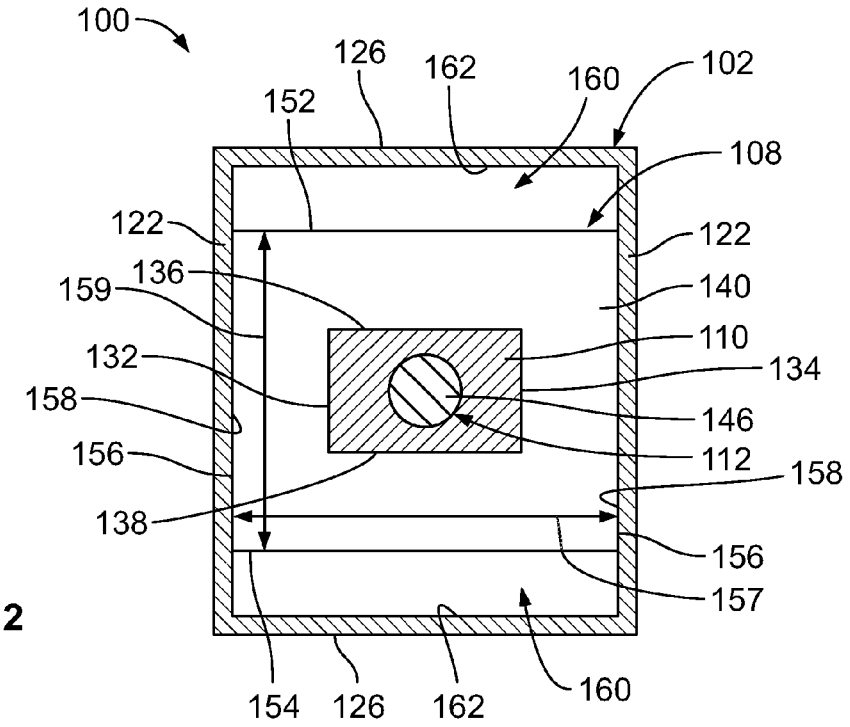
FIG. 2 is a cross-sectional view of the embodiment of the waveguide assembly shown in FIG. 1 taken along a line 2-2 shown in FIG. 1.

FIG. 2 is a cross-sectional view of the embodiment of the waveguide assembly 100 shown in FIG. 1 taken along a line 2-2 shown in FIG. 1. FIG. 2 shows the second dielectric waveguide 108 mated to the conductive waveguide 102. The second dielectric waveguide 108 is identical or at least similar to the first dielectric waveguide 106 shown in FIG. 1. The waveguide 108 may be fabricated by extrusion, drawing, fusing, molding, or the like.

The cladding 110 has a rectangular cross-sectional shape that includes a left edge 132, a right edge 134, a top edge 136, and a bottom edge 138. The left and right edges 132, 134 of the cladding 110 extend parallel to the side walls 122 of the conductive waveguide 102 in the mated position shown in FIG. 2. The top and bottom edges 136, 138 are longer than the left and right edges 132, 134. For example, in an embodiment the top and bottom edges 136, 138 are 1.0 mm, and the left and right edges 132, 134 are 0.6 mm. In various embodiments, the edges 132, 134, 136, and 138 may have other dimensions such that the cross-sectional area of the cladding 110 is between 0.2 and 4 mm2, or more specifically between 0.5 and 1 mm2. In an alternative embodiment, the left and right edges 132, 134 are longer than the top and bottom edges 136, 138. The cladding 110 is composed of a dielectric polymer material, such as polypropylene, polyethylene, PTFE, polystyrene, a polyimide, a polyamide, or the like, including combinations thereof. These materials generally have low loss characteristics which allow the waveguide 108 to transmit high-frequency signals for relatively long distances. The cladding material is different than the core material within the core region 112.

The core region 112 has a circular cross-sectional area. For example, the core region 112 may have a diameter between 0.1 and 1 mm, such as 0.3 mm. The core region 112 may have a rectangular (or at least oblong) cross-sectional shape in an alternative embodiment, such that the core region 112 defines planar sides that orient the fields propagating through the waveguide 108 instead of, or in addition to, the cladding 110. In the illustrated embodiment, the waveguide 108 includes a core member 146 within the respective core region 112. The core member 146 is composed of at least one solid dielectric material, such as polypropylene, polyethylene, PTFE, polystyrene, a polyimide, a polyamide, or the like, including combinations thereof. The core member 146 fills the core region 112 such that no clearances or gaps exist radially between the core member 146 and surfaces of the cladding 110 that define the core region 112. The cladding 110 therefore engages and surrounds the core member 146. In an alternative embodiment, the core material may be air or another gas-phase dielectric material instead of a solid material. Air has a low dielectric constant of approximately 1.0.

The outer jacket 140 of the waveguide 108 has a rectangular cross-sectional shape in the illustrated embodiment. For example, the outer jacket 140 includes a planar top surface 152, a planar bottom surface 154, and two planar side surfaces 156. A lateral width 157 of the outer jacket 140 extends between the two side surfaces 156. In an embodiment, the outer jacket 140 mechanically engages the side walls 122 of the conductive waveguide 102 to secure the dielectric waveguide 108 to the conductive waveguide 102. For example, the side walls 122 may be spaced apart laterally from each other a distance that is equal to, or at least slightly less than, the lateral width 157 of the outer jacket 140 such that the side surfaces 156 of the outer jacket 140 engage interior surfaces 158 of the side walls 122 to mechanically secure the waveguide 108 to the conductive waveguide 102. The dielectric waveguide 108 and the conductive waveguide 102 may be held together via an interference fit and/or an adhesive applied between the side surfaces 156 and the interior surfaces 158. In an alternative embodiment, the size of the conductive waveguide 102 can be larger than the outer dimension of the dielectric waveguide 108 to capture more electromagnetic energy.

In the illustrated embodiment, the connecting walls 126 of the conductive waveguide 102 are spaced apart by a distance that is greater than a vertical height 159 of the outer jacket 140 between the top and bottom surfaces 152, 154 such that openings 160 are defined between the top and bottom surfaces 152, 154 and interior surfaces 162 of the corresponding connecting walls 126. In an alternative embodiment, the connecting walls 126 may be spaced apart vertically from each other a distance that is equal to, or at least slightly less than, the vertical height 159 of the outer jacket 140 such that the top and bottom surfaces 152, 154 engage the corresponding connecting walls 126 in addition to, or instead of, the side surfaces 156 of the outer jacket 140 engaging the side walls 122.

The side walls 122 and the connecting walls 126 of the conductive waveguide 102 are composed of one or more metals or metal alloys that provide the waveguide 102 with electrically conductive properties. For example, the side walls 122 and/or connecting walls 126 may be sheets or panels of copper, aluminum, silver, or the like. In an alternative embodiment, the side walls 122 and/or connecting walls 126 may include a dielectric polymer in addition to one or more metals, such that the walls 122, 126 are metal-plated plastic panels or are formed by dispersing metal particles within a dielectric polymer.

The cross-section shown in FIG. 2 extends through the exposed portion 144 (shown in FIG. 1) of the cladding 110. In an embodiment, the cladding 110 along the exposed portion 144 within the channel 124 (shown in FIG. 1) is spaced apart laterally from the side walls 122 of the conductive waveguide 102 and is spaced apart vertically from the connecting walls 126. Thus, the cladding 110 does not engage any of the conductive walls 122, 126 and is fully surrounded by air. Optionally, the cladding 110 is approximately centered in the channel 124 of the conductive waveguide 102. The left and right edges 132, 134 of the cladding 110 extend parallel to the side walls 122 of the conductive waveguide 102.

Figure 3:
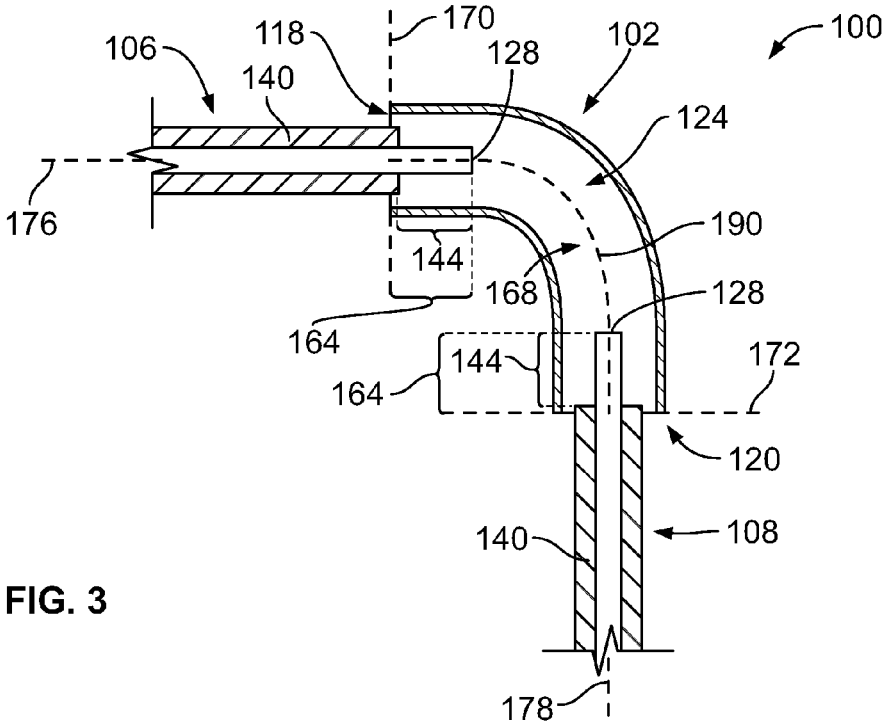
FIG. 3 is a cross-sectional view of the waveguide assembly according to an alternative embodiment.

FIG. 3 is a cross-sectional view of the waveguide assembly 100 according to an alternative embodiment. The first and second dielectric waveguides 106, 108 are mated to the conductive waveguide 102. Unlike the embodiment shown in FIG. 1, the conductive waveguide 102 in the illustrated embodiment bends along a curve and thus is not linear. For example, the first end 118 is oriented along a first plane 170, and the second end 120 is oriented along a second plane 172 that is transverse to the first plane 170. In the illustrated embodiment, the curve of the conductive waveguide 102 is a right angle curve such that the first plane 170 and the second plane 172 are approximately perpendicular. As shown in FIG. 3, the first dielectric waveguide 106 extends linearly into the channel 124 of the conductive waveguide 102 through the first end 118, and the second dielectric waveguide 108 extends linearly into the channel 124 through the second end 120. The first dielectric waveguide 106 is oriented along a first waveguide axis 176, and the second dielectric waveguide 108 is oriented along a second waveguide axis 178 that is transverse to the first waveguide axis 176. For example, the first and second waveguide axes 176, 178 are approximately perpendicular in FIG. 3 due to the right angle curve of the conductive waveguide 102.

The conductive waveguide 102 has strong field containment properties that allow the conductive waveguide 102 to be curved with a significantly tighter curve radius than is achievable by bending one of the dielectric waveguides 106, 108. For example, bending a dielectric waveguide in a tight curve may allow a significant amount of the propagating electromagnetic energy to be emitted from the waveguide and lost to the surrounding environment instead of propagating the full length of the waveguide. Although the illustrated waveguide assembly 100 shows the conductive waveguide 102 as a bridge connector that connects the two dielectric waveguides 106, 108, in another embodiment the first end 118 or the second end 120 may be connected directly to a communication device, such as an antenna, a transceiver, or the like, instead of to a dielectric waveguide. Thus, the conductive waveguide 102 is not limited to being used as a bridge between two dielectric waveguides 106, 108, and may be used to provide a bend or curve to electromagnetically connect a dielectric waveguide to a communication device.

Each of the dielectric waveguides 106, 108 defines an end segment 164 that includes the respective mating end 128. The end segments 164 are the portions of the waveguides 106, 108 that protrude into the channel 124 of the conductive waveguide 102. The remainders or remaining segments of the respective waveguides 106, 108 are exterior of the channel 124 and extend away from the conductive waveguide 102. In the illustrated embodiment, the exposed portions 144 of the cladding 110 constitute the majority of the end segments 164 as the outer jackets 140 protrude only slightly into the channel 124 beyond the corresponding first and second ends 118, 120. In an alternative embodiment, the exposed portions 144 may constitute the entire length of the end segments 164.

The lengths of the end segments 164 and/or the lengths of the exposed portions 144 may be selected to provide impedance matching between the dielectric waveguides 106, 108 and the conductive waveguide 102. For example, the conductive waveguide 102 follows a central axis 190 which is non-linear, such as curved, in the illustrated embodiment (but is linear in the embodiment shown in FIG. 1). Each of the end segments 164 extends into the channel 124 less than half of the axial length of the conductive waveguide 102. The mating ends 128 of the first and second dielectric waveguides 106, 108 are spaced apart from one another by a longitudinal gap 168 along the axial length of the conductive waveguide 102, which may be an air gap.

Figure 4:
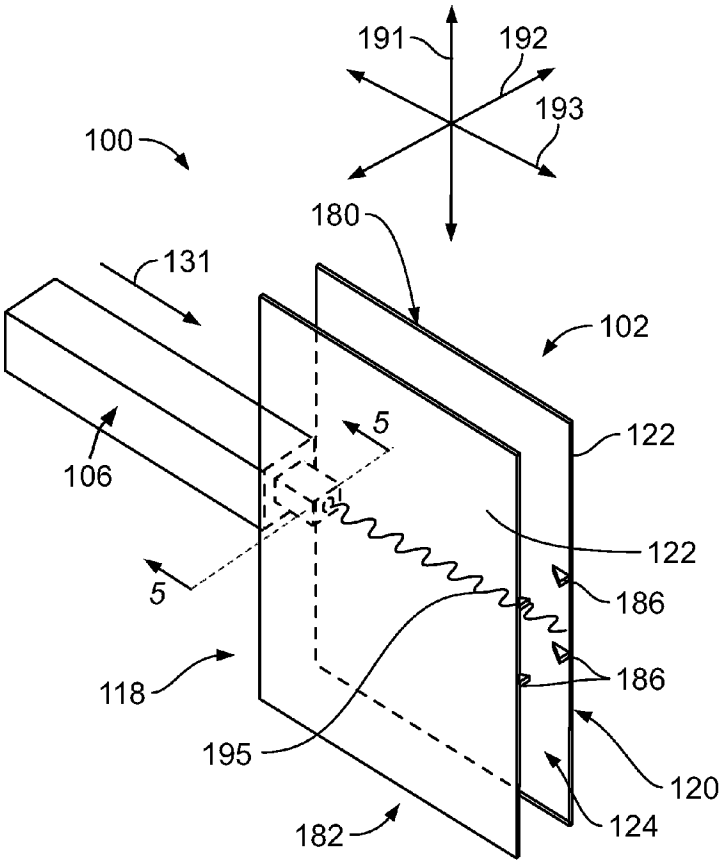
FIG. 4 is a perspective view of the waveguide assembly according to another embodiment.

FIG. 4 is a perspective view of the waveguide assembly 100 according to another embodiment. The conductive waveguide 102 includes two side walls 122 that are parallel to each other. Unlike the embodiment shown in FIG. 1, the conductive waveguide 102 does not include connecting walls that connect the two side walls 122. Thus, the conductive waveguide 102 is a parallel plate waveguide. Each of the side walls 122 extends a length along the longitudinal axis 193 between the first end 118 and the second end 120 of the conductive waveguide 102. The side walls 122 extend a height along the vertical axis 191 to define a top end 180 and a bottom end 182 of the conductive waveguide 102. The channel 124 is defined between the two side walls 122. In an embodiment, the side walls 122 are spaced apart from each other along the entire height of the conductive waveguide 102 such that the channel 124 is open at the top and bottom ends 180, 182.

Figure 5:
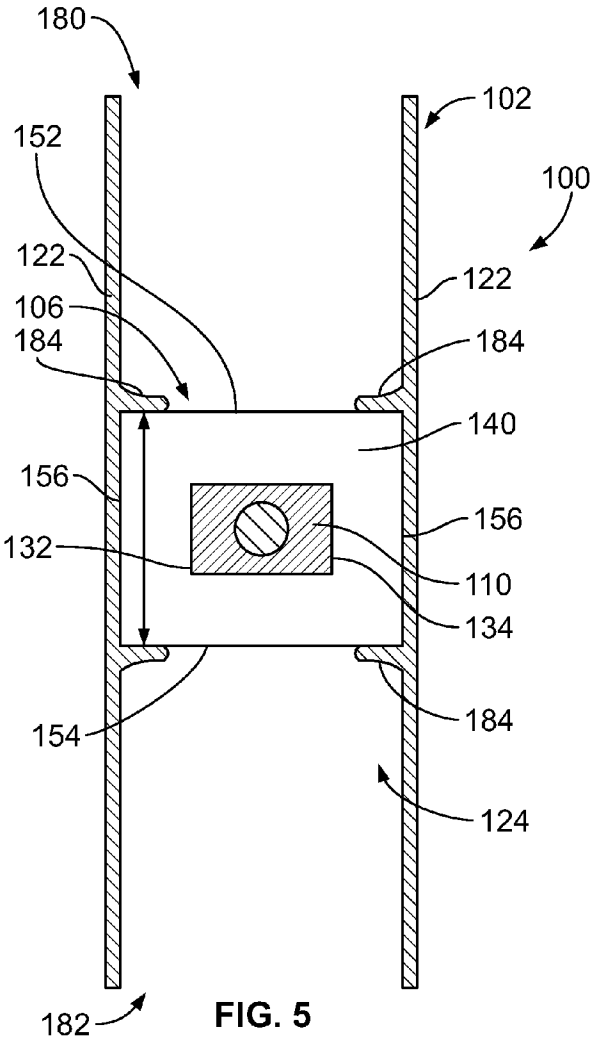
FIG. 5 is a cross-sectional view of the embodiment of the waveguide assembly shown in FIG. 4 taken along a line 5-5 shown in FIG. 4.

FIG. 5 is a cross-sectional view of the embodiment of the waveguide assembly 100 shown in FIG. 4 taken along a line 5-5 shown in FIG. 4. The side walls 122 are spaced apart laterally by a distance that is equal to, or slightly less than, the width of the outer jacket 140 of the dielectric waveguide 106 between the side surfaces 156. In an alternative embodiment, the space between the side walls 122 of the conductive waveguide 102 can be greater than the width of the outer jacket 140. The height of the outer jacket 140 between the top and bottom surfaces 152, 154 is significantly less than the height of the side walls 122 between the top and bottom ends 180, 182. The dielectric waveguide 106 is oriented relative to the conductive waveguide 102 such that the left and right edges 132, 134 of the rectangular cladding 110 are parallel to the side walls 122. The embodiment shown in FIGS. 4 and 5 supports propagation of electromagnetic signals through the waveguide assembly 100 that have a horizontal field polarization (along the lateral axis 192). For example, electromagnetic waves may propagate through the dielectric waveguide 106 in the first transmission direction 131 (FIG. 4) in a first mode of the waveguide 106 that has a horizontal field polarization. Upon transitioning into the conductive waveguide 102, the waves continue to propagate in the same direction 131 in a mode of the conductive waveguide 102 that also has a horizontal field polarization. For example, the fields are contained between the side walls 122. The waves are transverse such that components 195 (FIG. 4) of the wave may reflect between the side walls 122 as the signals propagate through the channel 124.

In FIG. 4, one dielectric waveguide 106 is mated to the conductive waveguide 102 at the first end 118. Although not shown, the conductive waveguide 102 is configured to receive a communication device or another dielectric waveguide (for example, the waveguide 108 shown in FIG. 1) at the second end 120 to provide an electromagnetic connection therebetween. In order to efficiently convey signals from the first dielectric waveguide 106 through the conductive waveguide 102 to another dielectric waveguide or a communication device, the dielectric waveguide 106 may need to align with the mating component along a signal transmission path through the conductive waveguide 102. For example, when the conductive waveguide 102 connects the first and second dielectric waveguides 106, 108, the second dielectric waveguide 108 at the second end 120 is aligned with the first dielectric waveguide 106. Furthermore, the second dielectric waveguide 108 is oriented similarly to the first dielectric waveguide 106 in order to propagate signals in the same vertical or horizontal polarization. For example, the left and right edges 132, 134 (shown in FIG. 2) of the rectangular cladding 110 (FIG. 2) of the second dielectric waveguide 108 may be parallel to the side walls 122 to match the orientation of the first dielectric waveguide 106.

In the illustrated embodiment, the side walls 122 include first alignment features 184 (shown in FIG. 5) at least proximate to the first end 118 and second alignment features 186 (shown in FIG. 4) at least proximate to the second end 120. The first alignment features 184 engage the top and bottom surfaces 152, 154 of the outer jacket 140 to position the first dielectric waveguide 106 vertically relative to the conductive waveguide 102. Likewise, the second alignment features 186 are configured to engage the top and bottom surfaces 152, 154 (shown in FIG. 2) of the outer jacket 140 (FIG. 2) of the second dielectric waveguide 108 (FIG. 2) to align the first and second waveguides 106, 108 along the signal transmission path. The first and second alignment features 184, 186 may be tabs, protuberances, tracks, or the like.

Figure 6:
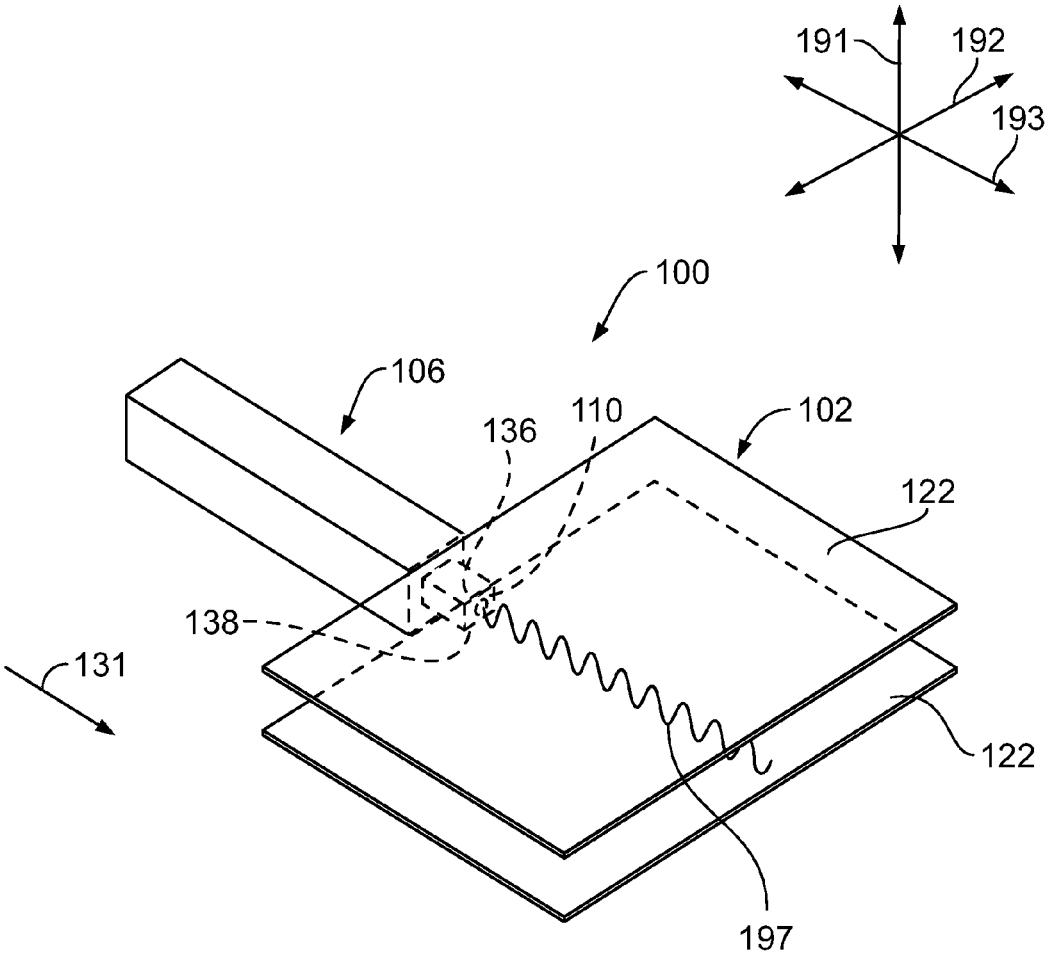
FIG. 6 is a perspective view of the waveguide assembly according to another embodiment.

FIG. 6 is a perspective view of the waveguide assembly 100 according to another embodiment. The illustrated embodiment differs from the embodiment shown in FIG. 4 because the side walls 122 of the conductive waveguide 102 extend parallel to the lateral axis 192 instead of parallel to the vertical axis 191 as shown in FIG. 4. Thus, the conductive waveguide 102 is rotated 90 degrees relative to the orientation shown in FIG. 4, while the dielectric waveguide 106 maintains the same orientation. The top and bottom edges 136, 138 of the rectangular cladding 110 extend parallel to the side walls 122 of the conductive waveguide 102. The illustrated embodiment supports propagation of electromagnetic signals through the waveguide assembly 100 that have a vertical field polarization (along the vertical axis 191). For example, electromagnetic waves propagate through the dielectric waveguide 106 in the first transmission direction 131 (along the longitudinal axis 193) in a second mode of the waveguide 106 that has a vertical field polarization (compared to the horizontal polarization of the first mode). Upon transitioning into the conductive waveguide 102, the waves continue to propagate in the same direction 131 in a mode of the conductive waveguide 102 that also has a vertical field polarization such that the fields are contained between the side walls 122 and components 197 of the waves reflect between the side walls 122.

The embodiments of the waveguide assembly 100 described above were tested over a range of 120 to 160 GHz. The insertion loss of all of the embodiments was less than 3.6 dB/m (decibels per meter) at 140 GHz, and some tested assemblies returned losses of less than 1 dB/m in certain modes of propagation. Thus, the waveguide assembly 100 may have acceptably low loss levels while providing simple electromagnetic coupling between two dielectric waveguides (without requiring precise alignment) and the ability to extend along a tight curve or bend.

The rectangular conductive waveguide 102 (shown in FIGS. 1-3) has field components along the propagation direction (for example, the longitudinal axis 193), which may be relatively large compared with field components in the transverse plane. The rectangular conductive waveguide 106 can support transverse electrical waves and transverse magnetic waves, but not transverse electromagnetic ("TEM") waves. The electric field in the transverse electrical wave may have a linear polarization along the lateral axis 192. The magnetic field in the transverse magnetic wave has a linear polarization that is perpendicular to the electric field polarization in the transverse plane (for example, the polarization may be along the vertical axis 191).

The parallel plate conductive waveguide 102 (shown in FIGS. 4 and 5) can support TEM waves having fields polarized between the two conductive plates or walls 122. All or at least most of the field components are confined within the transverse plane that is perpendicular to the propagation direction. In the TEM wave, the electric field has a polarization that is perpendicular to the two conductive walls 122. The magnetic field has a polarization that is perpendicular to the electric field polarization in the transverse plane.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A waveguide assembly for propagating electromagnetic signals along a defined path, the waveguide assembly comprising:

a conductive waveguide extending between a first end and a second end, the conductive waveguide including two side walls that extend parallel to each other between the first and second ends, the conductive waveguide defining a channel between the two side walls, the channel being open at the first and second ends; and a dielectric waveguide having a mating end, the dielectric waveguide including a cladding formed of a first dielectric material, the cladding defining a core region therethrough that is filled with a second dielectric material different than the first dielectric material, wherein the mating end of the dielectric waveguide is received in the channel at the first end of the conductive waveguide to electromagnetically connect the dielectric waveguide to the conductive waveguide, the channel defining an air gap between the mating end of the dielectric waveguide and the second end of the conductive waveguide, a remainder of the dielectric waveguide being exterior of the conductive waveguide and extending away from the conductive waveguide.

2. The waveguide assembly of claim 1, wherein the conductive waveguide further includes two connecting walls that extend parallel to each other and perpendicular to the side walls, the connecting walls extending between and mechanically engaging the side walls to enclose the channel, the channel having a rectangular prism shape.

3. The waveguide assembly of claim 1, wherein at least one of the cladding or the core region of the dielectric waveguide has a rectangular cross-sectional shape with parallel left and right edges and parallel top and bottom edges.

4. The waveguide assembly of claim 3, wherein the left and right edges extend parallel to the side walls of the conductive waveguide, the waveguide assembly propagating electromagnetic signals in the form of waves that propagate through the dielectric waveguide in a first mode, the waves propagating through the conductive waveguide with a horizontal field polarization.

5. The waveguide assembly of claim 3, wherein the top and bottom edges extend parallel to the side walls of the conductive waveguide, the waveguide assembly propagating electromagnetic signals in the form of waves that propagate through the dielectric waveguide in a second mode, the waves propagating through the conductive waveguide with a vertical field polarization.

6. The waveguide assembly of claim 1, wherein the dielectric waveguide has an outer jacket surrounding the cladding, the outer jacket extending to a jacket end that is recessed relative to the mating end of the dielectric waveguide such that an exposed portion of the cladding that is not surrounded by the outer jacket protrudes beyond the jacket end to the mating end, the exposed portion being received in the channel of the conductive waveguide.

7. The waveguide assembly of claim 6, wherein the outer jacket mechanically engages the side walls at the first end of the conductive waveguide to secure the dielectric waveguide to the conductive waveguide, the exposed portion of the cladding being spaced apart from the side walls within the channel and surrounded by air.

8. The waveguide assembly of claim 1, wherein the conductive waveguide is curved between the first and second ends, the first end of the conductive waveguide extending along a first plane, the second end of the conductive waveguide extending along a second plane that is transverse to the first plane.

9. The waveguide assembly of claim 1, wherein the dielectric waveguide is a first dielectric waveguide, the waveguide assembly further including a second dielectric waveguide having a mating end that is received in the channel at the second end of the conductive waveguide, the mating end of the second dielectric waveguide being spaced apart from the mating end of the first dielectric waveguide within the channel, the conductive waveguide bridging the first and second dielectric waveguides and electromagnetically connecting the first and second dielectric waveguides to each other.

10. The waveguide assembly of claim 9, wherein the side walls of the conductive waveguide include first alignment features at least proximate to the first end of the conductive waveguide and second alignment features at least proximate to the second end of the conductive waveguide, the first alignment features and the second alignment features configured to engage the first dielectric waveguide and the second dielectric waveguide, respectively, to align the first and second dielectric waveguides with one another along a signal transmission path through the conductive waveguide.

11. The waveguide assembly of claim 1, wherein the second dielectric material of the dielectric waveguide is at least one of air or a solid dielectric polymer.

12. A waveguide assembly for propagating electromagnetic signals along a defined path, the waveguide assembly comprising:

a conductive waveguide extending an axial length between respective first and second ends of the conductive waveguide, the conductive waveguide including two side walls that extend parallel to each other between the first and second ends, the conductive waveguide defining a channel between the two side walls, the channel being open at the first and second ends; and a dielectric waveguide having a mating end, the dielectric waveguide including a cladding formed of a first dielectric material, the cladding defining a core region therethrough that is filled with a second dielectric material different than the first dielectric material, wherein the mating end of the dielectric waveguide is received in the channel at the first end of the conductive waveguide to electromagnetically connect the dielectric waveguide to the conductive waveguide, the mating end received in the channel a distance less than half of the axial length of the conductive waveguide, a remainder of the dielectric waveguide being exterior of the conductive waveguide and extending away from the conductive waveguide.

13. A waveguide assembly for propagating electromagnetic signals along a defined path, the waveguide assembly comprising:

a conductive waveguide extending between a first end and a second end, the conductive waveguide including two side walls that extend parallel to each other between the first and second ends, the conductive waveguide defining a channel between the two side walls, the channel being open at the first and second ends; and first and second dielectric waveguides that have respective mating ends, each of the first and second waveguides including a respective cladding formed of a first dielectric material, the respective cladding defining a corresponding core region therethrough that is filled with a second dielectric material different than the first dielectric material, wherein the mating end of the first dielectric waveguide is received in the channel at the first end of the conductive waveguide and the mating end of the second dielectric waveguide is received in the channel at the second end, the mating end of the first dielectric waveguide being spaced apart from the mating end of the second dielectric waveguide within the channel, the conductive waveguide electromagnetically connecting the first and second dielectric waveguides to each other.

14. The waveguide assembly of claim 13, wherein the waveguide assembly defines a signal transmission path from the first dielectric waveguide into the conductive waveguide, and from the conductive waveguide into the second dielectric waveguide.

15. The waveguide assembly of claim 13, wherein the conductive waveguide is curved between the first and second ends, the first dielectric waveguide extending linearly into the channel through the first end along a first waveguide axis, the second dielectric waveguide extend linearly into the channel through the second end along a second waveguide axis that is transverse to the first waveguide axis.

16. The waveguide assembly of claim 13, wherein at least one of the cladding or the core region of each of the first and second dielectric waveguides has a rectangular cross-sectional shape with parallel left and right edges and parallel top and bottom edges, the left and right edges of each of the first and second dielectric waveguides extending parallel to the side walls of the conductive waveguide.

17. The waveguide assembly of claim 13, wherein each of the first and second dielectric waveguides has a respective outer jacket surrounding the corresponding cladding, the respective outer jacket extending to a jacket end that is recessed relative to the mating end of the respective dielectric waveguide such that an exposed portion of the respective cladding that is not surrounded by the corresponding outer jacket protrudes beyond the jacket end to the mating end, the exposed portion of the respective dielectric waveguide being received in the channel of the conductive waveguide.

18. The waveguide assembly of claim 13, wherein the conductive waveguide further includes two connecting walls that extend parallel to each other and perpendicular to the side walls, the connecting walls extending between and mechanically engaging the side walls to enclose the channel, the channel having a rectangular prism shape.

19. The waveguide assembly of claim 13, wherein the side walls of the conductive waveguide have a height between a top end and a bottom end, the side walls being spaced apart from each other along the entire height such that the channel is open at the top and bottom ends.

20. The waveguide assembly of claim 13, wherein the conductive waveguide extends an axial length between the first and second ends, the mating end of the first dielectric waveguide being spaced apart from the mating end of the second dielectric waveguide by a longitudinal air gap along the axial length.

* * * * *